US008474238B2

(12) United States Patent
Dhongade

(10) Patent No.: US 8,474,238 B2
(45) Date of Patent: Jul. 2, 2013

(54) SOLDERLESS LINKING METHOD AND STRUCTURE FOR JEWELRY

(75) Inventor: Saayli Dhongade, Mumbai (IN)

(73) Assignee: Elegant Collection, Andheri (East), Mumbai (IN)

( * ) Notice: Subject to any disclaimer, the term of this patent is extended or adjusted under 35 U.S.C. 154(b) by 124 days.

(21) Appl. No.: 13/115,511

(22) Filed: May 25, 2011

(65) Prior Publication Data

US 2012/0297749 A1 Nov. 29, 2012

(51) Int. Cl.
*F16G 13/00* (2006.01)

(52) U.S. Cl.
USPC ..... 59/80; 59/82; 63/4; D11/13

(58) Field of Classification Search
USPC ..... 59/78, 80, 82, 84, 85; D11/13; 63/4
See application file for complete search history.

(56) References Cited

U.S. PATENT DOCUMENTS

| | | | | | |
|---|---|---|---|---|---|
| 1,238,847 | A | * | 9/1917 | Vanderveld | 59/78 |
| 1,314,747 | A | * | 9/1919 | Hodges | 59/78 |
| 1,414,638 | A | * | 5/1922 | Grove | 59/80 |
| 1,797,968 | A | * | 3/1931 | Sweeney | 59/80 |
| 2,789,380 | A | * | 4/1957 | Philmus | 59/80 |
| 2,807,928 | A | * | 10/1957 | Wills | 59/80 |
| 3,360,923 | A | * | 1/1968 | Quisling | 59/78 |
| 4,448,017 | A | * | 5/1984 | Stark | 59/80 |
| 4,763,489 | A | * | 8/1988 | Strong | 63/4 |
| 5,097,787 | A | * | 3/1992 | Bruce | 114/293 |

* cited by examiner

*Primary Examiner* — David B Jones
(74) *Attorney, Agent, or Firm* — Levisohn Berger LLP

(57) ABSTRACT

A jewelry link assembly and method in which successive links are slipped onto prior links and are held together without the need for soldering between adjacent links. An infinitely hinged connection between adjacent links is formed permitting substantial flexibility when the hinged link bracelet assembly is so constructed.

6 Claims, 3 Drawing Sheets

SOLDERLESS LINKING METHOD AND STRUCTURE FOR JEWELRY

BACKGROUND OF THE INVENTION

This invention relates to a new and novel link for bracelets and other jewelry items in which the links are connected together without soldering.

Links in jewelry have long been attached to each other by soldering. Soldering permits pivoting of the links about a pivot bar connected between links, but the labor involved in such soldering is expensive, time consuming and detailed.

Additionally, soldering adjacent links together through a hinge bar, while permitting relative movement therebetween is also restrictive of such movement because of the physical connection. The connection between the pivot pin and links by soldering restricts the free and flowing movement of the individual links.

An object of this invention is to provide an improved method and apparatus for creating bracelets and the like out of a plurality of links without soldering.

Another object of this invention is to reduce the costs of assembling jewelry links to form bracelets and the like.

Another object is to use this invention to join links for any type of jewelry, including but not limited to bracelets, pendants, earrings and necklaces.

Yet another object of this invention is to provide a unique apparatus and method for assembling links in a chain or bracelet so as to enhance the flexible movement between the respective links and provide an almost ribbon-like feel as to how the bracelet drapes or follows the contour of the wrist and moves while being worn.

Another object is to provide such a bracelet in which the flexibility between the links is almost universal because of the lack of a fixed connection between respective links.

Still another object of this invention is to provide an assembly of links for a bracelet or other jewelry in which individual links can easily be added or removed so as to adjust the size of the item of jewelry without the need for extensive soldering.

Another object is to use this invention to join links for any type of jewelry, including bracelets, pendants and earrings.

The above other objects, advantages and features of this invention will become more apparent from the following description.

SUMMARY OF THE INVENTION

In accordance with the principles of this invention, the above objects are accomplished by providing a plurality of links in which each link has at opposite ends, a head and closed loop portion. Each link is an integral unit, and the assembly of the links one into the other is accomplished by ensuring that the size of the closed loop portion of each link is large enough so as to enable one link to slide into the next adjacent link.

This is accomplished by rotating the next adjacent link and slipping the closed loop portion through the perpendicularly orientated closed loop portion of the prior link. Once so slipped through, the links are then rotated to be in substantially the same head to closed loop portion orientation so as to be substantially in alignment as a standard chain.

The head portion of each link is of such size to capture the closed loop portion of the next link which then cannot slip out of the preceding link once assembled. In another embodiment, the head portion is formed of a decorative element of a size so as to capture the closed loop end of the next link when the links are rotated to be in a standard bracelet like orientation.

Assembly of the links as described may be accomplished for bracelets, necklaces, chains, earrings and any jewelry in which a plurality of links are connected together. More importantly, as in a bracelet, the significant benefits of this invention are realized because of the almost infinite ability of the assembled bracelet to have each link move with respect to the others so as to drape or gracefully rest on a person's wrist and move as the person's wrist moves providing a graceful, comfortable and sensual like silk feel.

This invention also allows for altering the size of the jewelry item containing the plurality of the assembled links. The last link is connected to an end clasp so that the bracelet can be closed and the links not separate. In order to add or remove links from the bracelet, the end clasp needs to be removed from the last link, and after such removal, any number of links can be added or removed from the previously assembled item of jewelry. After this is accomplished, the end clasp is then reattached so that the assembly of links are locked together.

DETAILED DESCRIPTION

Figure 1:
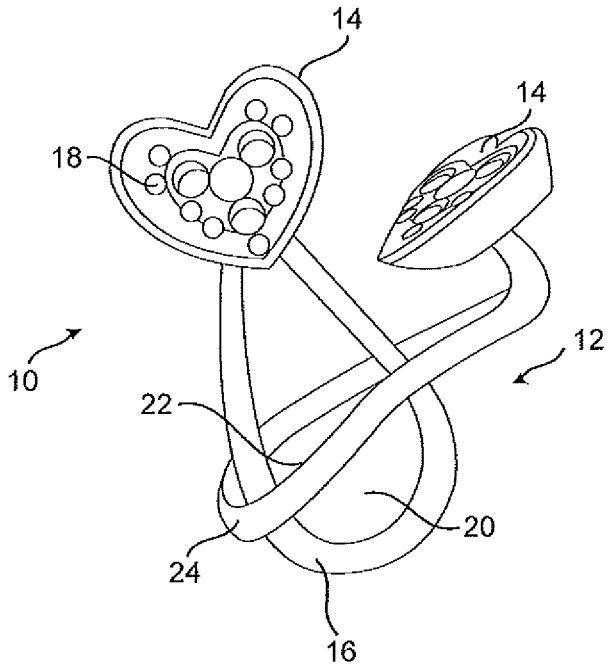
FIG. 1 is a perspective view of two interconnected links in the process of being connected.

In accordance with the principles of this invention, a pair of links 10 and 12 are shown being interconnected with each other. Each link is formed of a head portion 14 and a closed loop portion 16, with the head and closed loop portions being at opposite ends of the link. The link is an integrally formed unit or element in which a decorative head 18 is provided to which a decorative member may be attached. The opening 20 at the closed loop end 16 of the link is of such size such that link 12 has its opening 22 larger than the closed loop end 16 of link 10.

As shown in FIG. 1, the opening of the next or current link 12 is perpendicularly oriented with respect to closed loop end 16 of link 18 so as to allow opening 22 to slip over closed loop end 16 allowing the preceding 10 and next link 12 to be interconnected. Link 12 is then drawn forward allowing its closed end 24 to be captured under head 14 as link 12 is rotated to be in substantially the same orientation head to closed loop end as is link 10.

Figure 3:
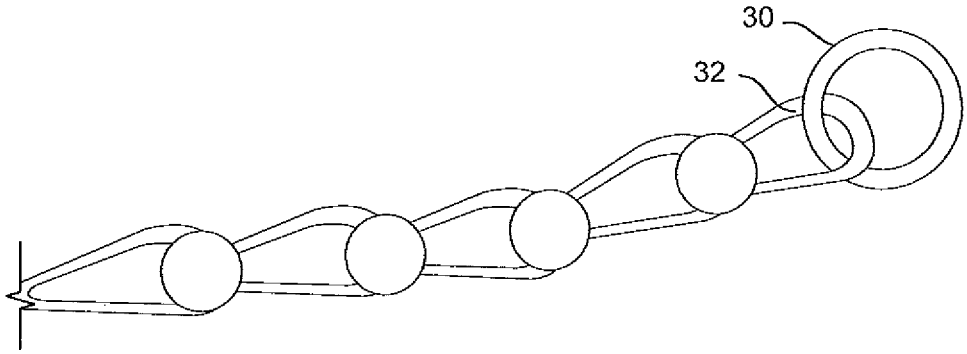
FIG. 3 is a partial top view of the embodiment of the interconnected links of FIG. 1 shown being connected to an end clasp.

When a plurality of links are assembled as shown in FIG. 1, the links will be arrayed in the standard end to end orientation as shown in FIG. 3. Once so arranged, the links will be able to pivotally move one with respect to the other without the use of solder or any other fixed securing mechanism between adjacent links.

The freedom of rotation and movement between respective interconnected links allows a draping or silky movement on a wearer's wrist because of the substantially total freedom of movement between respective links.

FIG. 3 shows an end clasp 30 directly connected by a ring 31 to the last link 32 of the plurality of links arranged and assembled as described above. This ensures the plurality of links stay connected together. The end clasp can be connected to the links by other means, but when so connected the links can not be removed from each other without first disconnecting the end clasp.

In order to adjust the length of the plurality of links, ring 31 is opened allowing the end clasp 30 of end link 32 to be removed and to permit successive links to either be added or removed. The reverse process described above when the links are assembled is used to remove links.

Figure 2:
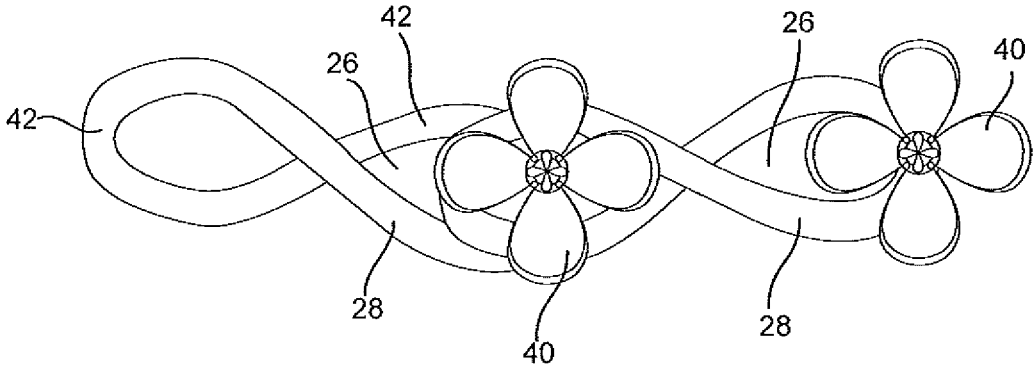
FIG. 2 is a top plan view of a plurality of a second embodiment of interconnected links of this invention.

FIG. 2 is a top plan view of a plurality of links constructed in accordance with the present invention in which an additional loop 26 is formed in each link so as to provide a slightly different ornamental appearance. The individual links 28 of the assembly of links shown in FIG. 3 also comprises head end 40 and opposite closed end 42 for each of the links. The same method of assembly by rotating one link to be substantially perpendicular to the other to allow it to be slipped over the preceding link is followed, so that the opening of closed loop end 42 slips and slides over the entire length of link 42 when link 40 is connected to link 42.

This invention is shown with respect to a single row of links. Multiple rows of links assembled in accordance with this invention may be produced and are included within the concept of the invention. A single end plate can be used for multiple rows, and all rows are connected together to the end clasp. Therefore, none of the links can be removed from any of the rows without the end clasp first being removed.

Although the present invention has been described in accordance with the embodiments shown, one of ordinary skill in the art will recognize that there could be variations to the embodiments and those variations would be within the spirit and scope of the present invention. Therefore, although the present invention was described in terms of a particular cluster mounting mechanism, one of ordinary skill in the art readily recognizes that any number of parameters can be utilized and their use would be within the spirit and scope of the present invention.

The invention claimed is:

1. A novel jewelry link assembly in which said assembly of links comprises interlocked links held together naturally without manually changing the structure of said links or deforming said links, said jewelry link of said jewelry link assembly comprising, at opposite ends, a head and body portion, said body portion terminating in rearward extending closed loop, said closed loop of the next link having an opening of sufficient size to slip over the closed loop portion of an adjacent and preceding link, said closed loop of said adjacent and preceding link being positioned to be substantially perpendicular to the plane of the closed loop of the next link enabling said links to be connected in a pivoting relationship, said head of said preceding link being larger than said closed loop opening of said next link, said head of each link being substantially perpendicular to the respective ones of said each link, said head being integrally formed with respective ones of said each link, said next link rotatable with respect to said preceding link such that its closed loop end is captured beneath the head of said preceding link and said next and preceding links are substantially in the same head to body portion orientation.

2. A novel jewelry link assembly according to claim 1, wherein the size of said novel jewelry link assembly may be adjusted by removing or adding links.

3. A novel jewelry link assembly according to claim 1, wherein said head comprises a decorative element.

4. A method to assemble a plurality of links without manually changing the structure of said links comprising, forming each link having at opposite ends a head and a closed loop end with said head being substantially perpendicular to said closed loop end, forming said head integrally with said closed loop end as part of said link, forming said closed loop end having an opening, slipping the opening of said closed loop end of a next link over the closed loop end of an adjacent and preceding link, performing said slipping step by rotating the closed loop end of the next link to pass over the closed loop end of the preceding and adjacent link and rotating the closed loop end of the next link to be in substantially the same head to loop end orientation as the preceding and adjacent link, and sizing said head element of said next link to capture the closed loop end of the preceding and adjacent link such that said links are connected together when said plurality of links are assembled.

5. A method to assemble a plurality of links according to claim 4, wherein said head element is a decorative element.

6. A method to assemble a plurality of links according to claim 4, further comprising adjusting the length of said plurality of links by adding or removing links by sliding adjacent links onto or off from adjacent links.

* * * * *